US008920183B2

(12) United States Patent
Shimada et al.

(10) Patent No.: US 8,920,183 B2
(45) Date of Patent: Dec. 30, 2014

(54) ELECTRIC CONNECTOR

(75) Inventors: Yoshinobu Shimada, Tokyo (JP); Masataka Muro, Tokyo (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 105 days.

(21) Appl. No.: 13/580,711

(22) PCT Filed: Aug. 2, 2011

(86) PCT No.: PCT/JP2011/067663

§ 371 (c)(1),
(2), (4) Date: Aug. 23, 2012

(87) PCT Pub. No.: WO2012/101849

PCT Pub. Date: Aug. 2, 2012

(65) Prior Publication Data

US 2012/0322293 A1 Dec. 20, 2012

(30) Foreign Application Priority Data

Jan. 27, 2011 (JP) ..... 2011-014734

(51) Int. Cl.
*H01R 13/15* (2006.01)
*H01R 12/79* (2011.01)
*H01R 12/88* (2011.01)

(52) U.S. Cl.
CPC ..... *H01R 12/79* (2013.01); *H01R 12/88* (2013.01)
USPC ..... 439/260; 439/495

(58) Field of Classification Search
CPC ..... H01R 12/88; H01R 12/85; H01R 12/82
USPC ..... 439/492, 495, 263, 260, 923
See application file for complete search history.

(56) References Cited

U.S. PATENT DOCUMENTS 6,089,905 A 7/2000 Shimmyo et al.
6,394,838 B1 * 5/2002 Yen ..... 439/492
7,435,130 B2 * 10/2008 Shen et al. ..... 439/495

(Continued)

FOREIGN PATENT DOCUMENTS

JP 62 154482 7/1987
JP 2000 30784 1/2000

(Continued)

OTHER PUBLICATIONS

International Search Report Issued Sep. 27, 2011 in PCT/JP11/67663 Filed Aug. 2, 2011.

(Continued)

*Primary Examiner* — Felix O Figueroa
(74) *Attorney, Agent, or Firm* — Oblon, Spivak, McClelland, Maier & Neustadt, L.L.P.

(57) ABSTRACT

To prevent, with a simple structure, deformation such as a twist of an actuator at the time of moving operation and easily check the operation state of an actuator to easily and reliably establish an electrical connection, inclined surface parts are provided at both end portions in a longitudinal direction in end faces on a rotational radial outer side of the actuator pinching or freeing a signal transmission medium to approximately uniformly act an entire pressing force of an operator over a full length of the actuator. With this, a situation that the actuator is pressed as being twisted is eliminated to achieve an excellent action of pinching the signal transmission medium and an easy and reliable visual check of the state of rotation of the actuator.

5 Claims, 17 Drawing Sheets

(56) References Cited

U.S. PATENT DOCUMENTS

| | | | | |
|---|---|---|---|---|
| 7,455,547 | B2 * | 11/2008 | Hemmi et al. | 439/495 |
| 7,534,130 | B2 * | 5/2009 | Tanaka et al. | 439/495 |
| 7,632,135 | B2 * | 12/2009 | Tsukumo | 439/495 |
| 7,648,377 | B2 * | 1/2010 | Naito et al. | 439/188 |
| 7,833,035 | B2 * | 11/2010 | Lin et al. | 439/260 |
| 8,128,425 | B2 * | 3/2012 | Takahashi et al. | 439/260 |
| 2007/0134975 | A1 * | 6/2007 | Shin | 439/495 |
| 2010/0081336 | A1 * | 4/2010 | Hemmi et al. | 439/658 |

FOREIGN PATENT DOCUMENTS

| | | |
|---|---|---|
| JP | 2004 071160 | 3/2004 |
| JP | 2004 79337 | 3/2004 |
| JP | 2009 64743 | 3/2009 |

OTHER PUBLICATIONS

U.S. Appl. No. 13/816,943, filed Feb. 14, 2013, Shimada.

* cited by examiner

ELECTRIC CONNECTOR

BACKGROUND OF THE INVENTION

1. Field of the Invention

The present invention relates to an electric connector configured so as to fix a signal transmission medium by moving an actuator.

2. Description of the Related Art

In general, in various electric apparatuses and others, various electric connectors are widely used as a device for electrically connecting various signal transmission media such as a flexible printed circuit (FPC) and a flexible flat cable (FFC). For example, in an electric connector for use as being mounted on a printed wiring board as described in Japanese Unexamined Patent Application Publication No. 2004-71160, a signal transmission medium formed of an FPC, an FFC, or the like is inserted into the inside of an insulating housing (an insulator) from its opening on a front end side, and then an actuator (connecting operation device) held at a "connection release position" for freeing the signal transmission medium at the time of insertion is rotated so as to be, for example, pushed down, toward a connecting action position on a front side or a rear side of the connector with an operating force of an operator.

When the actuator (connecting operation device) is operated to be rotated to a "connection acting position" for interposing the signal transmission medium, a cam member provided in the actuator presses conductive conducts. With this, the conductive contacts are displaced to be in press-contact with the signal transmission medium (such as FPC or FFC), thereby fixing the signal transmission medium. On the other hand, when the actuator at the "connection acting position" is rotated toward the original "connection release position" so as to, for example, rise upward, the conductive contacts are displaced in a direction of being spaced apart by their elasticity from the signal transmission medium (such as FPC or FFC), thereby causing the signal transmission medium to become in a free state.

As such, the actuator for the electric connector is configured to be operated to reciprocate between the "connection release position" and the "connection acting position" as, for example, being operated to rotate about a rotation center extending in a longitudinal direction of the actuator. As the size of the electric connector as a whole has been decreased in recent years, the size and height of the actuator itself has been decreased, and the stiffness of the actuator tends to decrease, thereby posing the following problems, for example. That is, when an actuator with its stiffness decreased due to decrease in size and height receives an operating force leaning to one direction in the longitudinal direction of the actuator, the actuator as a whole is deformed as being twisted, and the original operating force is not transmitted to a part of conductive contacts, thereby possibly causing a state in which the conductive contacts are not press-contacted and connected to the signal transmission medium (such as FPC or FFC) in a good condition.

Also, as downsizing of the actuator together with the entire electric connector is advanced, it becomes difficult to visually recognize to which position the actuator has been rotated, in particular, the state of the actuator rotated to the "connection acting position", thereby making it disadvantageously difficult to check the connection state of the conductive contacts.

SUMMARY OF THE INVENTION

Therefore, an object of the present invention is to provide an electric connector capable of preventing, with a simple structure, deformation such as a twist of an actuator at the time of moving operation and easily checking the operation state of the actuator, thereby allowing an electrical connection to be easily and reliably established.

To achieve the above-described object, in the present invention, in an electric connector in which an actuator pinching or freeing a signal transmission medium is provided so as to be rotatable about a rotation center extending in a longitudinal direction of the actuator, a structure is adopted in which inclined surface parts extending to form an appropriate angle with respect to the longitudinal direction are provided in outer end faces in a radial direction regarding the rotation center of the actuator and at both end portions in the longitudinal direction of the actuator.

According to the present invention with the above-described structure, to rotate the actuator from the "connection release position" to the "connection acting position", when a fingertip of an operator presses a rising wall when, for example, the actuator stands at the "connection release position", the fingertip of the operator is difficult to be hooked at the inclined surface parts provided at both end portions in the longitudinal direction. With this, the pressing force tends to be added to the center portion in the longitudinal direction of the actuator. On the other hand, the pressing force added to each of the inclined surface parts provided at both end portions in the longitudinal direction also acts in a direction at an approximately right angle with respect to the inclined surface of the inclined surface part, that is, from both ends side to a center side in the longitudinal direction of the actuator. For this reason, the operation pressing force added from the operator as a whole tends to uniformly act on a full length of the actuator. Thus, a situation that the actuator is pressed as being twisted, which conventionally occurs, is difficult to occur, and the actuator is rotated as a whole by keeping an approximately flat plane. With this, the action of pinching the signal transmission medium by the rotation of the actuator is excellently performed.

Furthermore, the outer shape is such that the inclined surface parts are disposed at both end parts in the longitudinal direction of the actuator. Thus, when the entire outer appearance of the actuator is viewed, it is visually recognized as a characteristic odd form having an approximately trapezoidal shape. Therefore, the rotation state of the actuator is easily and reliably checked in a visual manner.

Also, preferably in the present invention, a flat part extending in the longitudinal direction is provided in a portion between the inclined surface parts provided at the both end portions in the longitudinal direction, and the inclined surface parts are formed so as to smoothly continue from both end parts in a longitudinal direction of the flat part.

According to the present invention with the above-described structure, when the operating force is added to the actuator, a corner that causes concentration of stress at a boundary between the inclined surface parts and the flat part is not present. Therefore, it is possible to prevent possible damage due to the rotating operation of the actuator and others.

Still further, preferably in the present invention, rising wall parts extending in an approximately flat shape along a rotational radial direction of the actuator are provided at both end edge parts in the longitudinal direction of the actuator, and the inclined surface parts are provided so as to continue from outer end edges in a rotational radial direction of the rising wall parts.

According to the present invention with the above-described structure, compared with the case in which no rising wall part is provided, the stiffness of the actuator is increased by the rising wall parts. Thus, damage when the operating force is added to the actuator and others can be prevented.

Still further, preferably in the present invention, the appropriate angle formed by the inclined surface parts with respect to the longitudinal direction is set in a range of 4 degrees to 15 degrees.

According to the present invention with the above-described structure, it has been found that when the actuator is actually operated as being rotated, excellent uniformity of the operation pressing force over the full length of the actuator and stiffness of the full length of the actuator can be both obtained simultaneously.

Still further, preferably, each of the inclined surface parts in the present invention is provided with an operation prevention aiding part formed of a separate inclined surface adjacently disposed along the inclined surface part, and the inclined surface configuring the operation prevention aiding part extends from the inclined surface part to an outer end edge in a radial direction of a rising wall part extending in an approximately flat shape along a rotational radial direction of the actuator and along the longitudinal direction of the actuator to form an appropriate angle with respect to the rotational radial direction of the actuator.

According to the present invention with the above-described structure, the tendency that the fingertip of the operator is difficult to be hooked at the inclined surface parts at the time of operating the actuator as described above becomes more apparent with the operation prevention aiding part additionally provided to the inclined surface part, and the operation pressing force added from the operator further uniformly acts over the full length, making it difficult to cause a situation that the actuator is pressed as being twisted. The actuator is rotated as a whole by keeping an approximately flat plane, and the action of pinching the signal transmission medium by the rotation of the actuator is excellently performed.

Still further, preferably in the present invention, the operation prevention aiding part is disposed so as to face an operating force added to the actuator when the actuator is operated in a pinching direction from a state of freeing the signal transmission medium.

According to the present invention with the above-described structure, when the actuator is operated in a pinching direction, the fingertip of the operator is reliably difficult to be hooked at the inclined surface parts.

Still further, preferably in the present invention, an operation support part formed of a concave part or a convex part extending along the longitudinal direction of the actuator is provided at a center portion in a longitudinal direction, the rising wall part extending in an approximately flat shape along a rotational radial direction of the actuator and along the longitudinal direction of the actuator, the operation support part being provided in a portion where an operating force is added in a pinching direction from a state of freeing the signal transmission medium or a portion where an operating force is added in a freeing direction from a state of pinching the signal transmission medium. Here, the concave part or the convex part configuring the operation support part is preferably formed in a shape allowing engagement of a fingertip part or a nail part of an operator of the actuator.

According to the present invention with the above-described structure, at the time of operating the actuator, the nail part or the fingertip part of the operator of the actuator is easily hooked at the operation support part at the center portion in the longitudinal direction, and the operation pressing force added from the operator is positively received at the center portion of the actuator. With this, uniform operability can be reliably obtained.

Still further, preferably in the present invention, the operation support part is formed so as to extend in a curve or a straight line along the longitudinal direction of the actuator.

According to the present invention with the above-described structure, the nail part of the operator easily and reliably engages with the curved operation support part, and the fingertip part of the operator easily and reliably engages with the linear operation support. Therefore, the curved or liner operation support part is disposed as appropriate according to the state of the rotating operation, thereby obtaining excellent operability.

As described above, in the electric connector according to the present invention, inclined surface parts are provided in end faces outside of a rotation radius of the actuator pinching or freeing a signal transmission medium to approximately uniformly act the entire pressing force of the operator over the full length of the actuator. With this, a situation that the actuator is pressed as being twisted is eliminated, the action of pinching the signal transmission medium is excellently performed, and the rotation state of the actuator is easily and reliably checked in a visual manner. Thus, it is possible to prevent, with a simple structure, deformation such as a twist of an actuator at the time of moving operation and easily check the operation state of the actuator, thereby allowing an electrical connection to be easily and reliably established and significantly increasing the quality and reliability of the electric connector at low cost.

DETAILED DESCRIPTION OF THE PREFERRED EMBODIMENT

Figure 1:
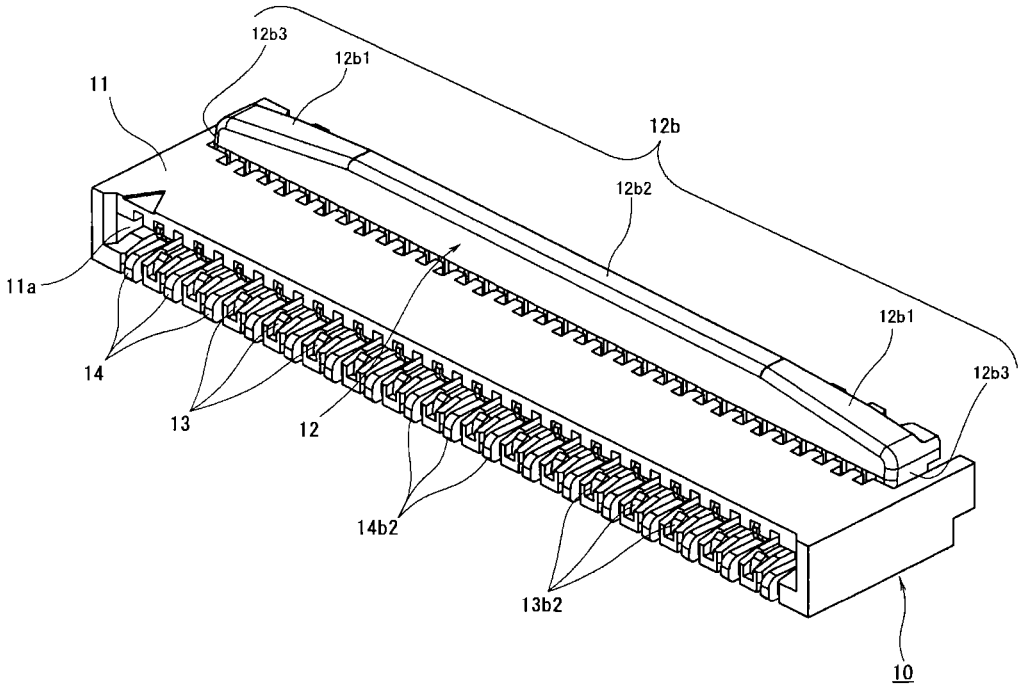
FIG. 1 is a descriptive external perspective view of an electric connector according to a first embodiment of the present invention, showing an entire structure when viewed from a front side in the state where an actuator stands at a connection release position with a signal transmission medium not being inserted.
Figure 2:
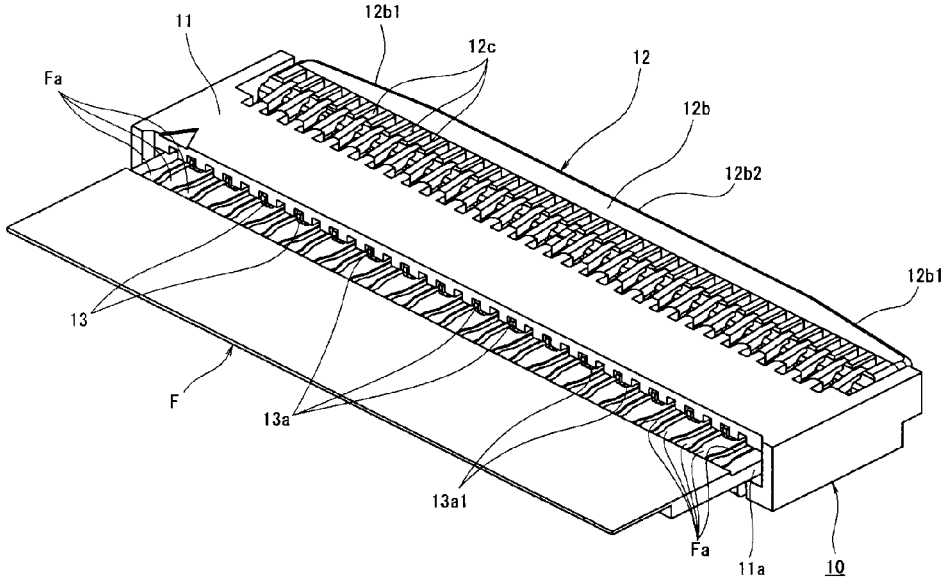
FIG. 2 is a descriptive external perspective view of the entire structure when viewed from the front side in the state where the signal transmission medium is inserted in the electric connector depicted in FIG. 1 and then the actuator is rotated so as to be pushed down to a connection acting position.
Figure 3:
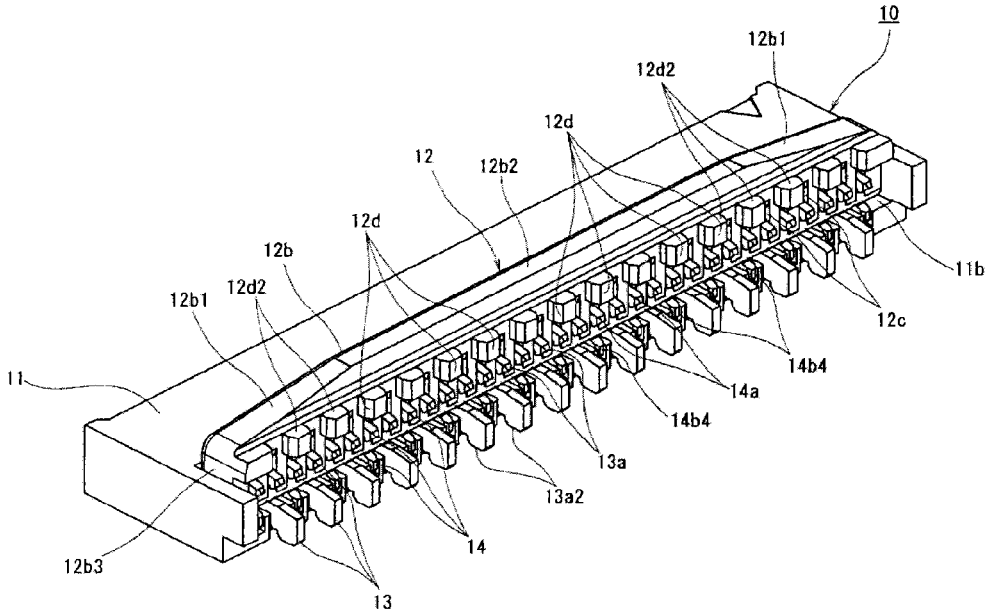
FIG. 3 is a descriptive external perspective view of the electric connector in a connection release state depicted in FIG. 1 when viewed from a rear side.
Figure 4:
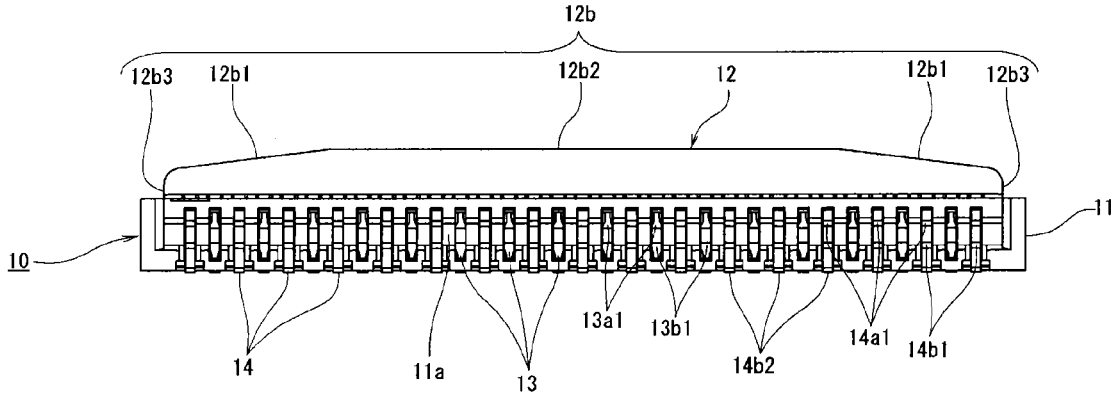
FIG. 4 is a descriptive front view of the electric connector in the connection release state depicted in FIG. 1 when viewed from a front side.
Figure 5:
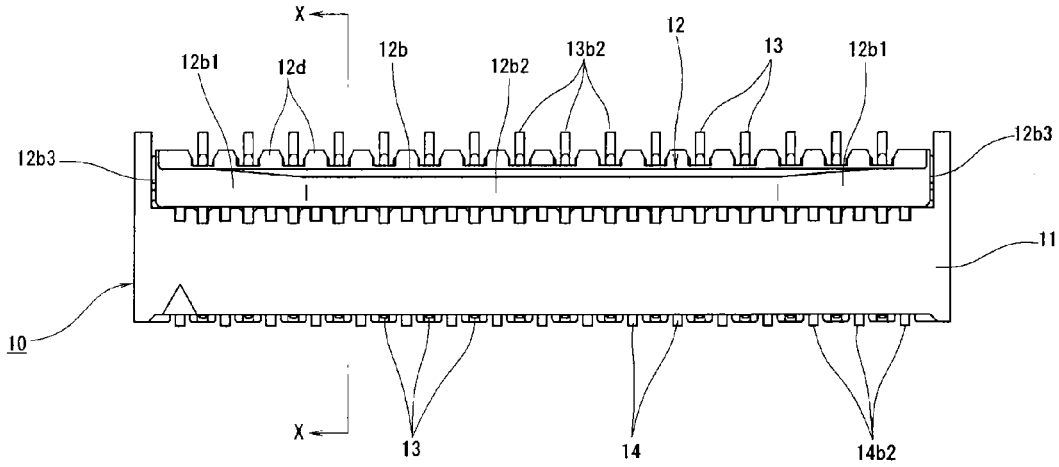
FIG. 5 is a descriptive plan view of the electric connector in the connection release state depicted in FIG. 1 when viewed from an upper side.
Figure 6:
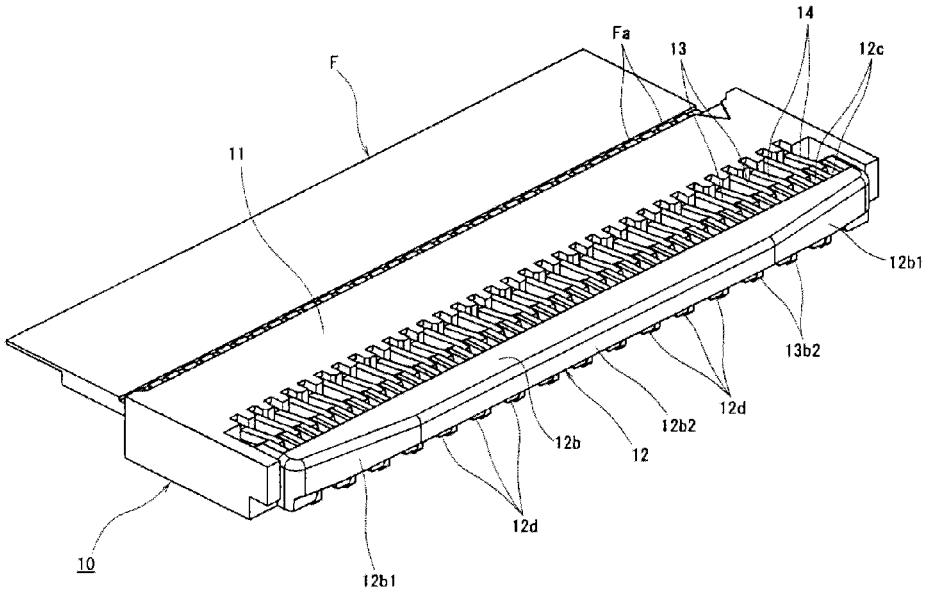
FIG. 6 is a descriptive external perspective view of the electric connector in a connection acting state depicted in FIG. 2 when viewed from a rear side.

An embodiment is described in detail below based on the drawings, in which the present invention is applied to an electric connector for use as being mounted on a wiring board for connecting a signal transmission medium formed of a flexible printed circuit (FPC), a flexible flat cable (FFC), or the like.

That is, an electric connector 10 depicted in FIG. 1 to FIG. 17 according to a first embodiment of the present invention has a so-called back-flip-type structure in which an actuator 12 as connecting operation device is provided on a rear end edge portion (a right end edge portion in FIG. 10) of an insulating housing 11. The actuator 12 described above is configured to be rotated so as to be pushed down toward a connector rear side (a right side in FIG. 10) opposite to a connector front end side (a left end side in FIG. 10) in which a terminal portion of a signal transmission medium (such as FPC or FFC) F is inserted.

Here, while the insulating housing 11 is formed of a hollow-frame-shaped insulating member extending in an elongated shape, a longitudinal breadth direction of the insulating housing 11 is hereinafter referred to as a connector longitudinal direction, and a direction in which the terminal portion of the signal transmission medium (such as FPC or FFC) F is inserted or disengaged is hereinafter referred to as a connector front-back direction.

In the inside of the insulating housing 11 described above, a plurality of conductive contacts 13 and 14 having two different shapes each formed of a thin-plate-like metal-made member having an appropriate shape are mounted. The conductive contacts 13 and 14 are disposed in a multi-contact manner as being spaced apart from each other along the connector longitudinal direction inside the insulating housing 11. The conductive contacts 13 on one side and the conductive contacts 14 on the other side that have different shapes are alternately arranged in the connector longitudinal direction, which is a direction of multi-contact arrangement. These conductive contacts 13 and 14 are each used as either a contact for signal transmission or a contact for ground connection as being mounted by solder joint on a conductive path (not shown) formed on a main printed wiring board (refer to a reference character P in FIG. 12 and FIG. 13).

In a front end edge portion of the insulating housing 11 (a left end edge portion in FIG. 10), a medium insertion opening 11*a* in which the terminal portion of the signal transmission medium F formed of a flexible printed circuit (FPC), a flexible flat cable (FFC), or the like as described above is inserted is provided so as to form an elongated shape in the connector longitudinal direction. In its opposite rear end edge portion (a right end edge portion in FIG. 10) in the connection front-back direction, a component mount opening 11*b* for mounting the conductive contacts 13 on one side described above, the actuator (connecting operation device) 12, and others is provided so as also to form an elongated shape.

Figure 10:
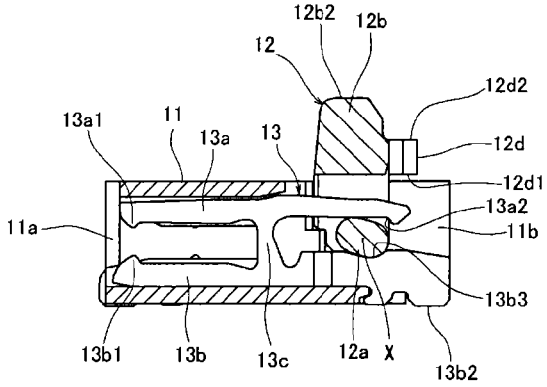
FIG. 10 is a descriptive cross-sectional view along an X-X line in FIG. 5.

Note that while the conductive contacts 13 on one side described above are mounted by being inserted from the component mount opening 11*b* provided on the connector rear end side of the insulating housing 11 toward a front side (a left side in FIG. 10), the conductive contacts 14 on the other side are mounted by being inserted from the medium insertion opening 11*a* provided on the connector front end side of the insulating housing 11 toward a rear side (a right side in FIG. 10). Each of these conductive contacts 13 and 14 mounted inside the insulating housing 11 as described above is disposed at a position corresponding to a wiring pattern Fa of the signal transmission medium (such as FPC or FFC) F inserted inside of the insulating housing 11 via the medium insertion opening 11*a*. The wiring pattern Fa formed on the signal transmission medium F is formed by disposing conductive paths for signal transmission (signal line pads) or conductive paths for shielding (shield line pads) with appropriate pitch spaces.

On the other hand, the conductive contacts 13 and 14 have a pair of a movable beam 13*a* and a fixed beam 13*b* and a pair of a movable beam 14*a* and a fixed beam 14*b*, respectively, each formed of an elongated beam member extending approximately in parallel along the front-back direction, which is an insertion/removal direction of the signal transmission medium F (a lateral direction in FIG. 10). These movable beams 13*a* and 14*a* and the fixed beams 13*b* and 14*b* are disposed so as to face each other as being appropriately spaced apart from each other in an inner space of the insulating housing 11 described above in a vertical direction in the drawings. Of these, the fixed beams 13*b* and 14*b* are fixed to be in an approximately unmovable state along an inner wall surface of a bottom plate of the insulating housing 11, and the movable beams 13*a* and 14*a* extending approximately in parallel at upper positions in the drawing of the fixed beams 13*b* and 14*b* are integrally coupled to the fixed beams 13*a* and 13*b* via coupling support parts 13*c* and 14*c*, respectively.

The coupling support parts 13*c* and 14*c* are each formed of a plate-shaped member having a narrow width, and are disposed so as to extend in the vertical direction in the drawings in an approximately center portion in a direction in which both of the beams 13*a* and 14*a* and 13*b* and 14*b* extend. The movable beams 13*a* and 14*a* coupled to upper end portions in the drawing of the coupling support parts 13*c* and 14*c*, respectively, are configured to be able to be elastically displaced with respect to the fixed beams 13*b* and 14*b*, respectively, based on elastic flexibility of the coupling support parts 13*c* and 14*c*. The movable beams 13*a* and 14*a* are configured to be able to swing by taking the coupling support parts 13*c* and 14*c* or nearby as a rotation center. Here, the swinging of the movable beams 13*a* and 14*a* is performed in a vertical direction on paper in FIG. 10.

Also, front-end-side portions (left-end-side portions in FIG. 10) of the movable beams 13*a* and 14*a* described above are provided with upper terminal contact convex portions 13*a*1 and 14*a*1, respectively, to be connected to any wiring pattern (conductive path for signal transmission or for shielding) Fa formed on an upper side of the signal transmission medium (such as FPC or FFC) F in the drawings so as to form a downward projected shape in the drawings.

On the other hand, the fixed beams 13*b* and 14*b* are disposed so as to extend in the front-back direction along the inner wall surface of the bottom plate of the insulating housing 11 as described above. Front-side portions (a left-side portion in FIG. 10) of these fixed beams 13*b* and 14*b* are provided with lower terminal contact convex parts 13*b*1 and 14*b*1, respectively, to be connected to the wiring pattern (conductive path for signal transmission or for shielding) Fa formed on a lower side of the signal transmission medium (such as FPC or FFC) F in the drawings so as to form an upward projected shape in the drawings. These lower end contact convex parts 13*b*1 and 14*b*1 are disposed so as to face positions straight below the upper terminal contact convex parts 13*a*1 and 14*a*1 on movable beams 13*a* and 14*a* sides, respectively, in the drawings. Between these upper and lower terminal contact convex parts 13*a*1 and 13*b*1 and upper and lower terminal contact convex parts 14*a*1 and 14*b*1, the signal transmission medium F is pinched.

Note that these upper and lower terminal contact convex parts 13*a*1 and 13*b*1 of the movable beam 13*a* and the fixed beam 13*b* and upper and lower terminal contact convex parts 14*a*1 and 14*b*1 of the movable beam 14*a* and the fixed beam 14*b* can be disposed so as to be shifted in position to a connector front side (a left side in FIG. 10) or a connector rear side (a right side in FIG. 10). Also, while the fixed beams 13*b* and 14*b* are fixed basically in an unmovable state, their tip portion can be formed so as to be able to be elastically displaced for the purpose of facilitating insertion of the signal transmission medium (such as FPC or FFC) F or other purposes. The front end portion of each of the fixed beams 13*b* and 14*b* can also be formed so as to slightly float from the inner wall surface of the bottom plate of the insulating housing 11.

Figure 12:
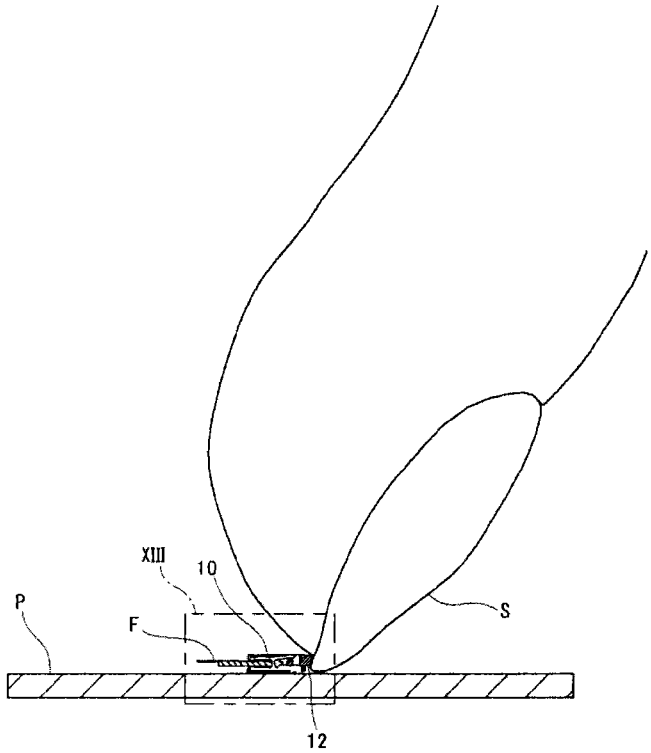
FIG. 12 is a descriptive cross-sectional view showing an operation of pulling up the actuator depicted in FIG. 2 and FIG. 9 pushed down to the connection acting position with a nail of an operator.
Figure 13:
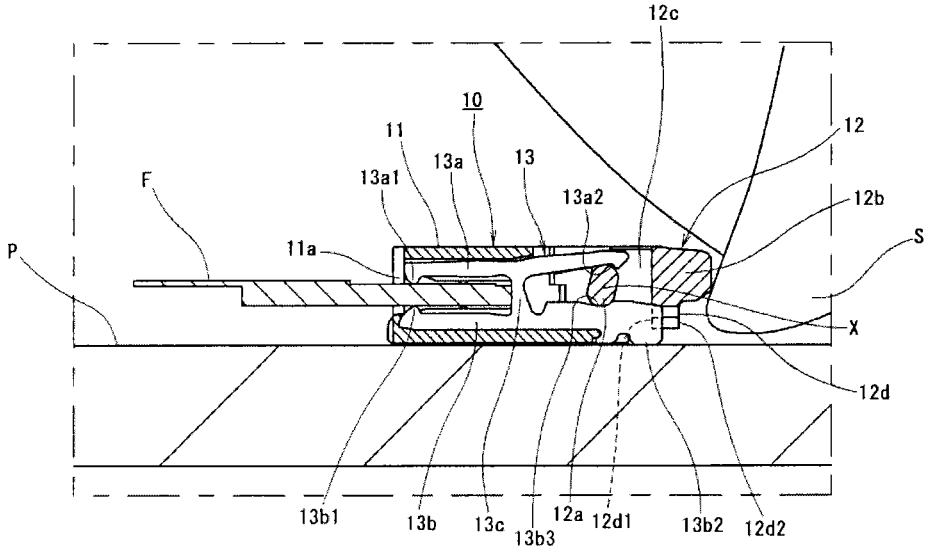
FIG. 13 is a descriptive enlarged cross-sectional view of a region denoted as a reference character III in FIG. 12, showing one conductor contact.
Figure 14:
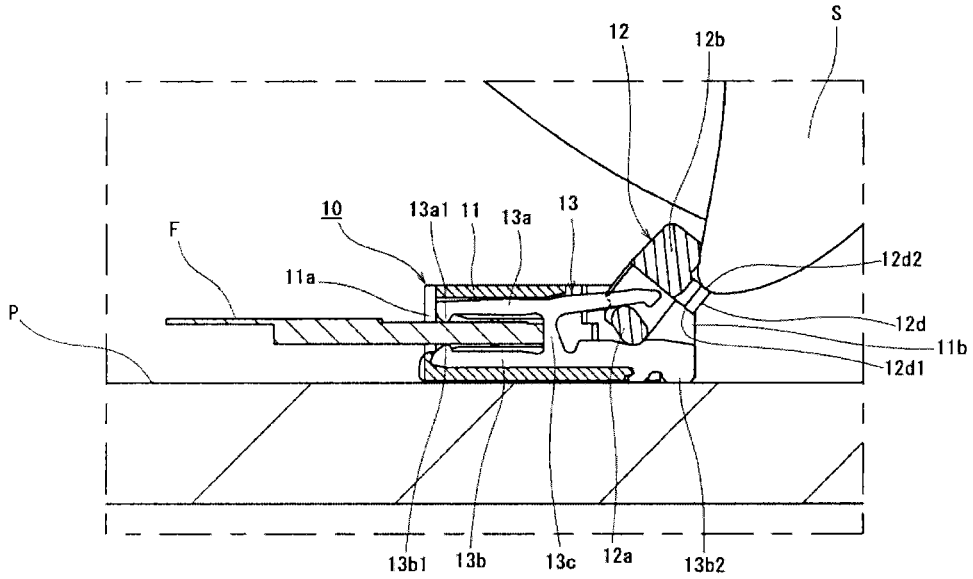
FIG. 14 is a descriptive cross-sectional view of the state where, from the state of being pushed down to the connection acting position in FIG. 13, the actuator is slightly pulled up.
Figure 15:
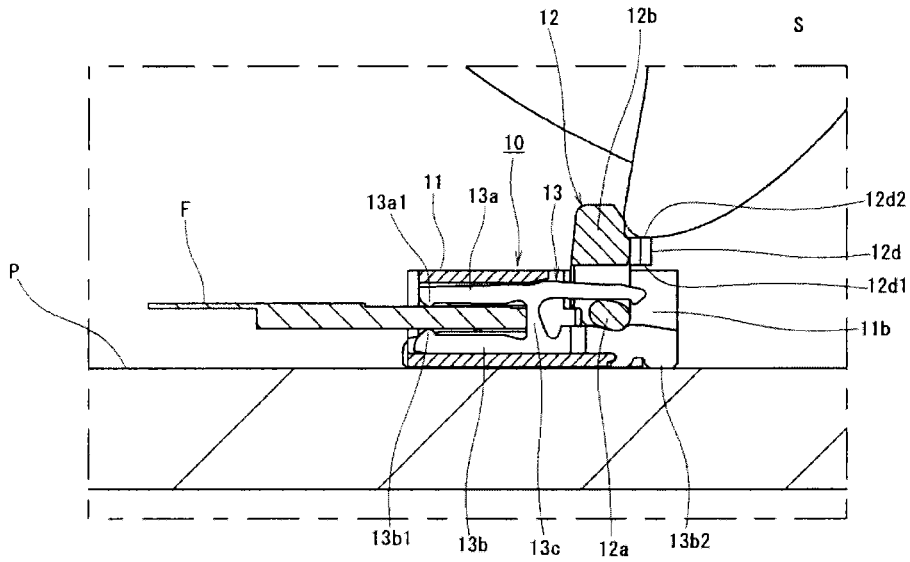
FIG. 15 is a descriptive cross-sectional view corresponding to FIG. 13, showing the state where the actuator is pulled up to the connection release position.
Figure 16:
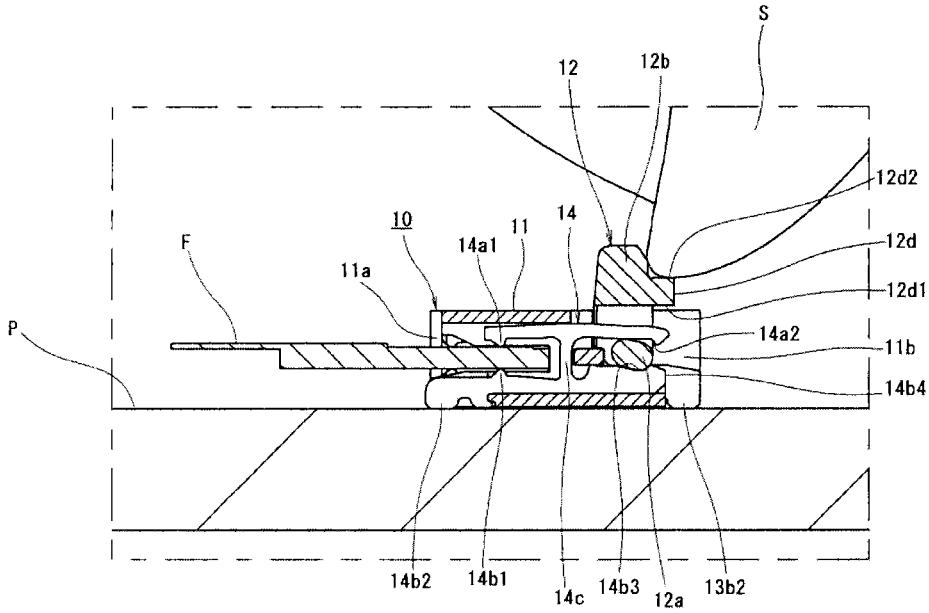
FIG. 16 is a descriptive cross-sectional view corresponding to FIG. 15, the view showing the state where the actuator is pulled up to the connection release position and showing another conductive contact.
Figure 17:
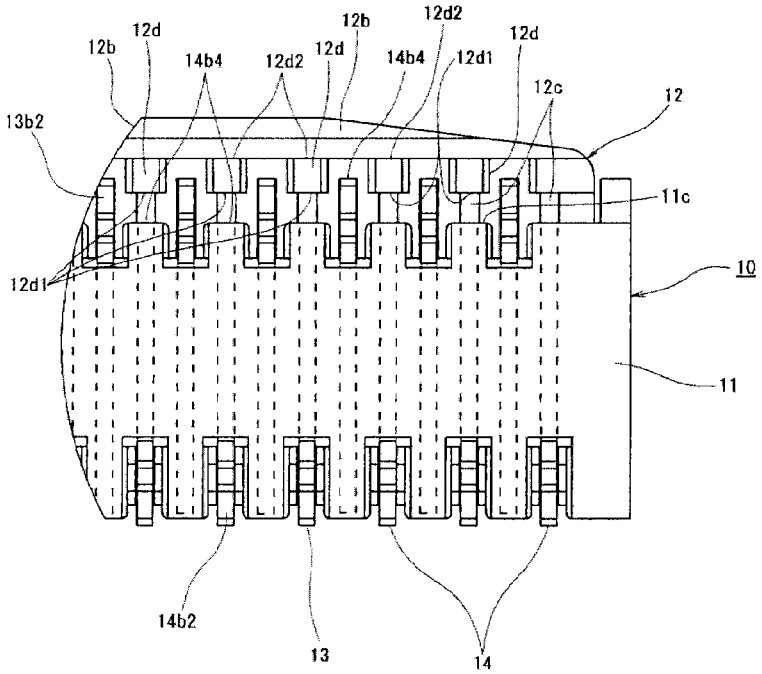
FIG. 17 is a descriptive partial bottom view of the state where the actuator is pushed down to the connection acting position, when viewed from a lower side.

Furthermore, a rear-end-side portion (a right-end-side portions in FIG. 10) of the fixed beam 13*b* and a front-end-side portion (a left-end-side portion in FIG. 10) of the fixed beam 14*b* described above are provided with board connecting parts 13*b*2 and 14*b*2, respectively, to be connected by solder to a conductive path formed on the main wiring board (refer to the reference character P in FIG. 12 and FIG. 13).

Still further, rear-end-side portions (right-end-side portions in FIG. 10) of the movable beams 13*a* and 14*a* are provided with cam receiving portions 13*a*2 and 14*a*2, respectively, and rear-end-side portions (right-end-side portions in FIG. 10) of the fixed beams 13*b* and 14*b* are provided with cam receiving concave portions 13*b*3 and 14*b*3, respectively formed so as to each form a concave shape. In these cam receiving parts 13*a*2 and 14*a*2 and cam receiving concave parts 13*b*3 and 14*b*3, a pressing cam part 12*a* of the actuator (connecting operation device) 12 mounted at the rear end portion of the insulating housing 11 described above is disposed in contact. A cam surface formed along an outer perimeter of this pressing cam part 12*a* is slidably in contact with the cam receiving parts 13*a*2 and 14*a*2 of the movable beams 13*a* and 14*a* and the cam receiving concave parts 13*b*3 and 14*b*3 of the fixed beams 13*b* and 14*b*. With this contact arrangement relation, the actuator 12 is rotatably supported about a rotation center X of the pressing cam part 12*a* (refer to FIG. 10 and FIG. 11).

Figure 11:
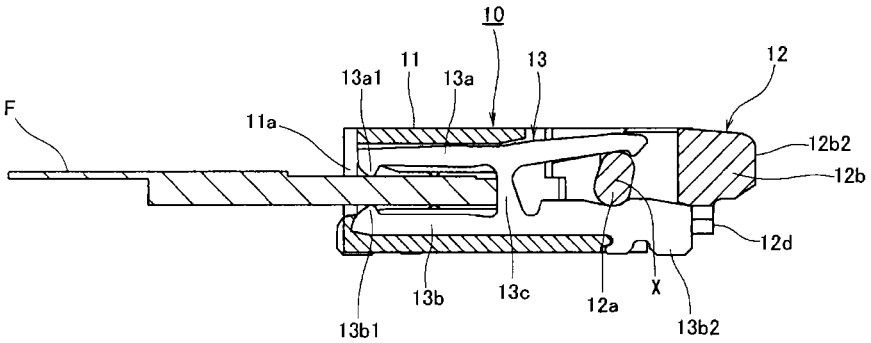
FIG. 11 is a descriptive cross-sectional view along an XI-XI line in FIG. 7.

Here, for example, as depicted in FIG. 11, the cam receiving parts 13*a*2 and 14*a*2 of the movable beams 13*a* and 14*a* and the cam receiving concave parts 13*b*3 and 14*b*3 of the fixed beams 13*b* and 14*b* described above are configured to lightly fit in the pressing cam part 12*a* rotated to the "connection acting position", thereby holding the pressing cam part 12*a* in the state of being rotated up to the "connection acting position" in FIG. 11.

On the other hand, the entire actuator (connecting operation device) 12 disposed as being rotated at the rear end portion (the right-end-side portion in FIG. 10 and FIG. 11) of the insulating housing 11 as described above is formed so as to extend in an elongated shape along the connector longitudinal direction, and is disposed over an approximately same length as the full width of the insulating housing 11. This actuator 12 is mounted so as to be above to move about a rotation center extending in a longitudinal direction of the actuator 12, that is, the rotation center X (refer to FIG. 10 and FIG. 11) of the pressing cam part 12*a* described above, with a portion outside the rotation radius regarding the rotation center X (a right-end-side portion in FIG. 11) is formed as an open/close operating part 12*b*. With an appropriate operating force being added by the operator to the open/close operating part 12*b*, the entire actuator 12 is rotated so as to reciprocate between the "connection release position" at which the actuator 12 stands approximately upright as depicted in FIG. 10 and the "connection acting position" at which the actuator 12 is fallen down approximately horizontally toward a connector rear side as depicted in FIG. 11.

Here, in a portion of the open/close operating part 12*b* coupled to the pressing cam part 12*a*, a slit-shaped through hole part 12*c* is formed for avoiding interference with the conductive contacts 13 and 14. When the actuator 12 is rotated to the "connection release position" (refer to FIG. 10), the rear end portions of the movable beams 13*a* and 14*a* of the conductive contacts 13 and 14 enter the inside of the slit-shaped through hole part 12*c*.

On the other hand, it is configured that when the open/close operating part 12*b* of the actuator (connecting operation device) 12 is operated to be rotated by hand of the operator so as to be pressed down from the "connection release position" (refer to FIG. 10) toward the "connection acting position" (refer to FIG. 11), the rotation radius of the pressing cam part 12*a* described above is changed in a direction of increasing between the fixed beams 13*b* and 14*b* and the movable beams 13*a* and 14*a*, respectively. Then, according to the change of increasing the radius of the pressing cam part 12*a*, the cam receiving parts 13*a*2 and 14*a*2 provided on the rear end sides of the movable beams 13*a* and 14*a*, respectively are displaced so as to be lifted up to an upper side in the drawings. Accordingly, the upper terminal contact convex parts 13*a*1 and 14*a*1 provided on a side (a connector front end side) opposite to the cam receiving parts 13*a*2 and 14*a*2 are pushed downward.

If the actuator (connecting operation device) 12 has been completely rotated to the "connection acting position", which is a final rotation position (refer to FIG. 11), the upper terminal contact convex parts 13*a*1 and 14*a*1 of the movable beams 13*a* and 14*a* and the lower terminal contact convex parts 13*b*1 and 14*b*1 of the fixed beams 13*b* and 14*b*, respectively, described above vertically press-contact the signal transmission medium (such as FPC or FFC) F inserted therebetween to pinch the signal transmission medium F. At this time, the upper terminal contact convex parts 13*a*1 and 14*a*1 and the lower terminal contact convex parts 13*b*1 and 14*b*1 are press-contacted with the wiring pattern of the signal transmission medium (conductive path for signal transmission or for shielding) Fa, thereby establishing an electrical connection.

On the other hand, with the actuator 12 being rotated so as to be pushed down from the "connection release position" (refer to FIG. 10) toward the rear side and moved to the "connection acting position" (refer to FIG. 11) as described above, a lower-surface-side portion of the open/close operating part 12*b* of the actuator 12 in the drawings are disposed so as to have a relation of facing close to a main wiring board P. Here, on the lower-surface-side portion of the open/close operating part 12*b* of the actuator 12, protective projections 12*d* protruding toward the main wiring board are provided. These plurality of protective projections 12*d* are disposed a predetermined space apart from each other in the multi-contact arrangement direction of the conductive contacts 13 and 14 (connector longitudinal direction) described above. The protective projections 12*d* each formed as a block body having a shape of an approximately quadrangular prism are integrally rotated according to the rotating operation of the actuator 12.

More specifically, each protective projection 12*d* is disposed at a position corresponding to the conductive contact 14 having the shape on the other side described above in the connector longitudinal direction, that is, in the multi-contact arrangement direction of the conductive contacts 13 and 14. That is, the protective projection 12*d* is disposed between the board connecting parts 13*b*2 of adjacent conductive contacts 13 having the shape on one side in the multi-contact arrangement direction. Therefore, when the protective projections 12*d* are rotated together with the entire actuator 12, the state of non-interference is always kept with respect to the board connecting part 13*b*2 of each conductive contact 13 on one side.

Also, for each conductive contact 14 having the shape on the other side, an inner end face 12*d*1 inside of the rotation radius of each protective projection 12*d* is disposed at a non-interfering position corresponding to the rear side (the right side in FIG. 16) of the conductive contact 14. That is, with the actuator 12 being at the "connection acting position", the inner end face 12*d*1 of the protective projection 12*d* is disposed so as to face at a position slightly away from a rear end face (an upper end face in FIG. 17) 14*b*4 of the fixed beam 14*b* configuring the conductive contact 14 on the other side, to a rear side (an upper side in FIG. 17). With this facing arrangement relation in which both end faces are spaced apart from each other, a non-interference state with respect to the conductive contact 14 on the other side can be kept.

Furthermore, an arrangement relation is such that the position of a rear end edge part (an upper end edge part in FIG. 17) 11*c* of the bottom plate of the insulating housing 11 in which the conductive contact 14 on the other side held is positioned in the connector front-back direction (a horizontal direction in FIG. 16) to approximately match with a rear end face (an upper end face in FIG. 17) 14*b*4 of the conductive contact 14 on the other side. Therefore, also for the rear end edge part (the upper end edge part in FIG. 17) 11*c* of the bottom plate of the insulating housing 11, the inner end face 12*d*1 of the protective projection 12*d* described above is disposed so as to face at a position slightly away to the rear side (the upper side in FIG. 17). With this facing arrangement relation in which both end faces are spaced apart from each other, a non-interference state of each protective projection 12*d* with respect to the insulating housing 11 is kept.

Still further, an outer end face 12*d*2 of each protective projection 12*d* provided outside the rotation radius is disposed at a position drawn slightly inward (leftward in FIG. 10 and FIG. 13) from an operation-side outer end face (a right end face in FIG. 10 and FIG. 13) of the open/close operating part 12*b* of the actuator 12 also outside the rotation radius. The outer end face 12*d*2 of each protective projection 12*d* is provided so as to form a step on the operation-side outer end face of the open/close operating part 12*b* of the actuator 12. In particular, as depicted in FIG. 13, a nail S of the operator is easily hooked, from a lower side, at the step formed of the protective projection 12*d* described above and a portion outside the rotation radius from that step.

The outer end face 12*d*2 of the protective projection 12*d* forming this step is disposed at a position slightly protruding from the rear end face (the right end face in FIG. 10 and FIG. 13) of the board connecting part 13*b*2 provided on each conductive contact 13 on one side described above toward the rear side of the actuator 12 (the right side in FIG. 10 and FIG. 13), that is, toward an operation-side outer end face side of the actuator 12 with the actuator 12 being moved to the "connection acting position". Therefore, when the nail S of the operator is inserted toward the inside of the connector (a left side in FIG. 13), the nail S of the operator abuts on the outer end face 12*d*2 of the protective projection 12*d*. Therefore, the nail S of the operator is prevented from being in contact with the board connecting part 13*b*2 of the conductive contact 13.

Also, the nail S of the operator abuts on the outer end face 12*d*2 of the protective projection 12*d*. Therefore, when the actuator 12 is rotated from the "connection acting position" to the "connection release position", a situation is prevented that the nail S of the operator enters a pressing cam portion 12*a* side from the outer end face 12*d*2 to become contact with the movable beams 13*a* and 14*a* of the conductive contact protruding from the slit-shaped through hole part 12*c* of the actuator 12.

As such, the gap formed between the actuator 12 and the main printed wiring board P is covered with the protective projection 12 provided to the actuator 12 from the rear side (the right side in FIG. 13) of the actuator 12. With this, a chance is eliminated that the nail S of the operator is in contact with a connector component such as the conductive contacts 13 and 14 disposed inside the gap between the actuator 12 and the main printed wiring board P.

Also, the protective projection 12*d* is provided so as to form a step on the operation-side outer end face of the open/close operating part 12*b* provided in the actuator 12. With this, when an operation of rotating the actuator 12 is performed, a nail tip part of the operator is easily hooked at the step between the actuator 12 and the protective projection 12*d*, and thus the operation of rotating the actuator 12 is safely and reliably performed.

Furthermore, the protective projection 12*d* is disposed at a portion between board connecting parts 13*b*2 of adjacent ones of the conductive contacts 13 in the multi-contact arrangement direction. With this, when the actuator 12 is moved to the "connection acting position", the protective projection 12*d* of the actuator 12 enters the portion between the board connecting parts 13*b*2 of the conductive contacts 13 to prevent interference between the actuator 12 and the conductive contacts 13. Therefore, even if the actuator 12 is reduced in a length direction of the conductive contacts 13 orthogonal to the multi-contact arrangement direction, no interference occurs. Also, the portion between the board connecting parts 13*b*2 of the conductive contacts 13 is covered with the protective projection 12*d* of the actuator 12, and thus a situation is prevented that a foreign substance such as dust enters that portion to cause an electric short circuit.

Still further, the protective projection 12*d* is disposed so as to protrude to an operator side of the actuator 12 from the rear end face of the board connecting part 13*b*2 of each conductive contact 13. With this, the tip of the nail S of the operator is in contact with the protective projection 12*d* of the actuator 12 to disable further insertion, and therefore the tip of the nail S of the operator is reliably prevented from being in contact with the end face of the board connecting part 13*b*2 of the conductive contact 13.

In addition, the protective projection 12*d* is disposed at a position not interfering with the insulating housing 11 in the reciprocating rotation direction of the actuator 12. With this, it is not required to decrease the size of the insulating housing 11 to avoid interference with the protective projection 12*d* of the actuator 12 and, accordingly, the ability of holding the conductive contacts 13 and 14 is excellently kept.

On the other hand, as described above, the open/close operating part 12*b* of the actuator 12 extends long along the connector longitudinal direction. On an operation-side end face disposed outside of a radial direction regarding the rotation center X of the open/close operating part 12*b*, that is, an upper end face with the actuator 12 standing at the "connection release position" (refer to FIG. 4 and FIG. 5), inclined surface parts 12*b*1 are provided on both end portions in the connector longitudinal direction. These inclined surface parts 12*b*1 are each formed so as to go down toward outside in the connector longitudinal direction, which is an extending direction of the actuator 12, and so as to extend to form an appropriate angle with respect to the connector longitudinal direction. On a portion between these inclined surface parts 12*b*1, a flat part 12*b*2 is provided to extend in the connector longitudinal direction, which is the extending direction of the actuator 12.

Here, the appropriate angle of each inclined surface part 12*b*1 with respect to the connector longitudinal direction, that is, an angle in a downward direction with respect to a horizontal line obtained by extending the flat part 12*b* described above, is set in a range of 4 degrees to 15 degrees in the present embodiment. The reason for this setting of the inclined angle is that it has been found that when the actuator 12 is actually operated as being rotated, excellent uniformity of the operation pressing force over the full length of the actuator 12 and stiffness of the full length of the actuator 12 can be both obtained simultaneously.

Still further, the inclined surface parts 12*b*1 disposed on both end sides in the connection longitudinal direction described above are formed so as to smoothly continue from both end parts of the flat part 12*b*2 provided on the center side in the connector longitudinal direction, and no corner is formed at a boundary between the surface parts 12*b*1 and 12*b*2.

Still further, on both end edge parts of the open/close operating part 12*b* provided to the actuator 12 in the connector longitudinal direction, both-end-side rising wall parts 12*b*3 forming an approximately flat shape are provided. These both-end-side rising wall parts 12*b*3 are each formed so as to extend along a rotational radial direction of the actuator 12. That is, with the actuator 12 standing at the "connection release position" (refer to FIG. 4 and FIG. 5), each both-end-side rising wall part 12*b*3 is formed so as to extend upward approximately in a vertical direction from the upper surface of the insulating housing 11 described above. From an upper end part of each rising surface part 12*b*3, the inclined surface part 12*b*1 is contiguously provided.

As such, in the present embodiment, since the inclined surface parts 12*b*1 are provided on both end parts of the open/close operating part 12*b* of the actuator 12, the following advantages can be obtained. That is, when the actuator 12 is rotated from the "connection release position" to the "connection acting position", the rising wall part on a front side, which is the front end face (the left-side end face in FIG. 10) with the actuator 12 standing at the "connection release position" (refer to FIG. 10), is pressed with a fingertip of the operator. If the inclined surface parts 12*b*1 are provided on both end portions of the open/close operating part 12*b* of the actuator 12 as described above, the pressing force of the operator is difficult to be exerted onto portions on both end sides in the longitudinal direction where the inclined surface parts 12*b*1 are provided. With this, the pressing force tends to be added onto a center portion of the actuator 12 in the longitudinal direction.

On the other hand, the pressing force added onto portions where the inclined surface parts 12*b*1 on both sides of the actuator 12 in the longitudinal direction are provided is added in an approximately right angle direction with respect to the inclined surfaces of the inclined surface parts 12*b*1. For this reason, the pressing force of the operator approximately uniformly acts over the full length of the actuator 12, preventing the occurrence of a situation that the entire actuator 12 is pressed as being twisted. The actuator 12 is rotated as a whole by keeping an approximately flat plane. As a result, the action of pinching the signal transmission medium (such as FPC or FFC) F by the rotation of the actuator 12 is excellently performed.

Figure 7:
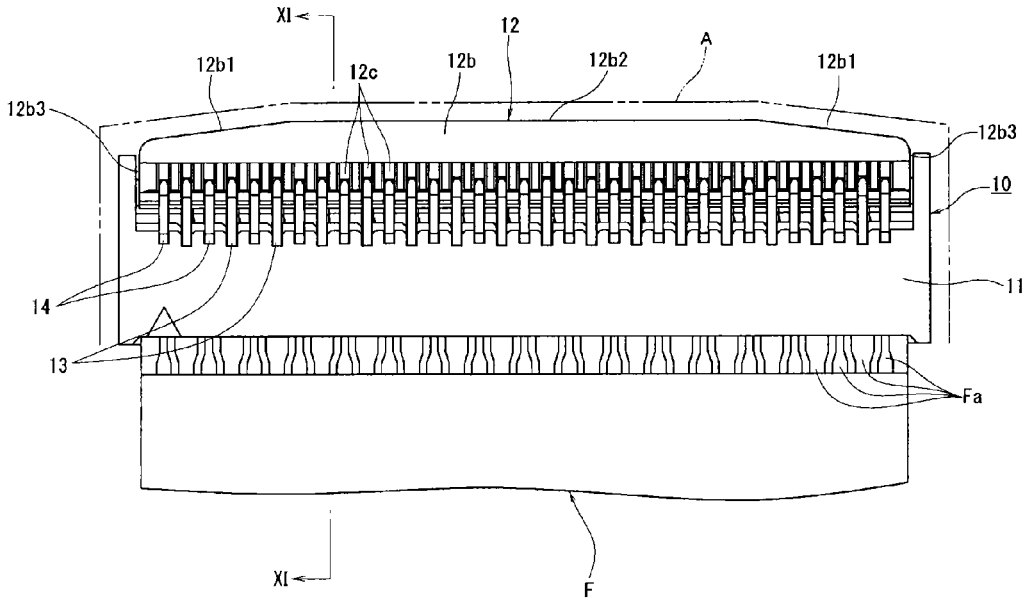
FIG. 7 is a descriptive external perspective view of the electric connector in a connection acting state depicted in FIG. 2 when viewed from an upper side.
Figure 8:
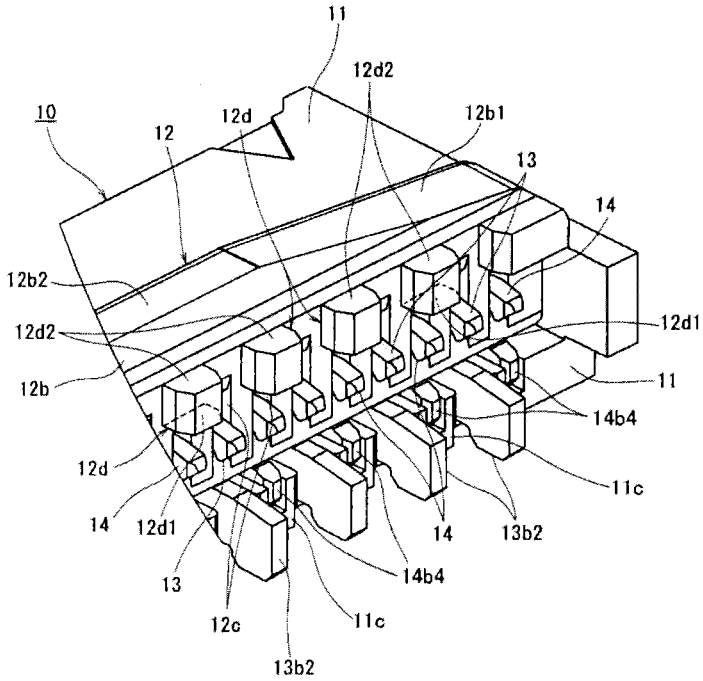
FIG. 8 is a descriptive enlarged external perspective view of an end portion in a longitudinal direction of the electric connector in the connection release state depicted in FIG. 3.
Figure 9:
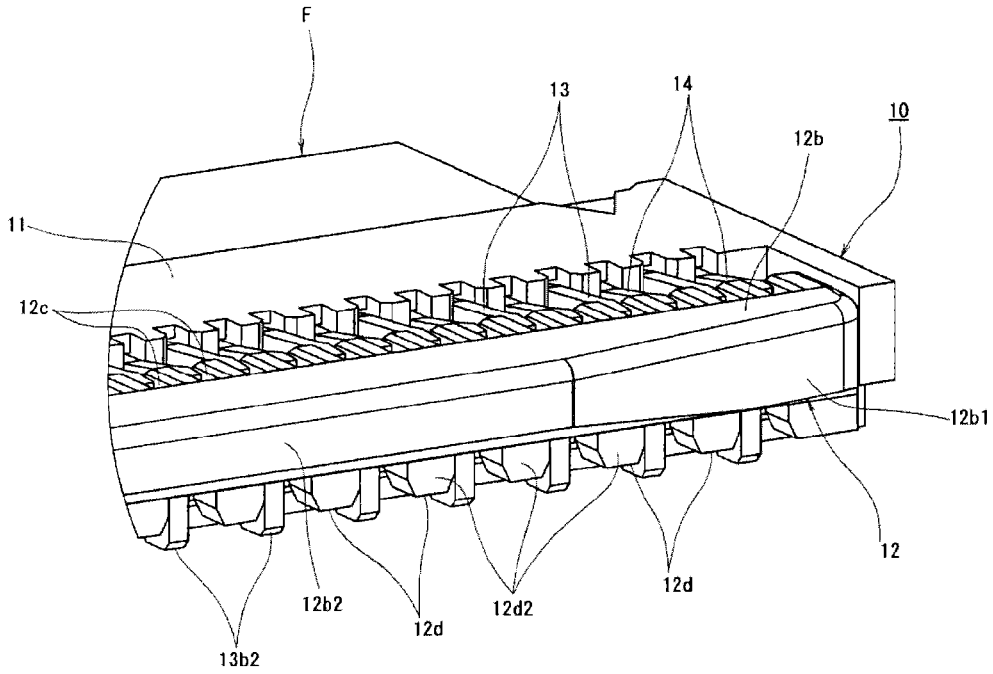
FIG. 9 is a descriptive enlarged external perspective view of an end portion in a longitudinal direction of the electric connector in the connection acting state depicted in FIG. 6.

Furthermore, when the entire external view of the actuator 12 is visually checked, in particular, as depicted with a two-dot-chain line denoted as a reference character A in FIG. 7, it is visually recognized as having an odd form with an approximately trapezoidal shape. In particular, with the actuator 12 being rotated to the "connection acting position" (refer to FIG. 7), the entire external view of the actuator 12 is visually conspicuous as having an approximately trapezoidal shape in a planar view. Therefore, the rotation state of the actuator 12 to the "connection acting position" is easily and reliably checked.

Still further, as in the present embodiment, with the structure in which the inclined surfaces configuring the inclined surface parts 12*b* 1 smoothly continue from the flat part 12*b*2, if the operating force is added onto the actuator 12, no corner part is present that causes concentration of stress at a boundary between the surface parts 12*b*1 and 12*b*2, and therefore damage on the actuator 12 due to the operation of rotating the actuator and others can be prevented.

In addition, as in the present embodiment, with the inclined surface parts 12*b*1 being provided via the both-end-side rising wall parts 12*b*3, the stiffness in the open/close operating part 12*b* of the actuator 12 can be increased accordingly to the provision of the both-end-side rising wall parts 12*b*3, thereby making it possible to prevent damage and others when the operating force is added onto the actuator 12.

Figure 18:
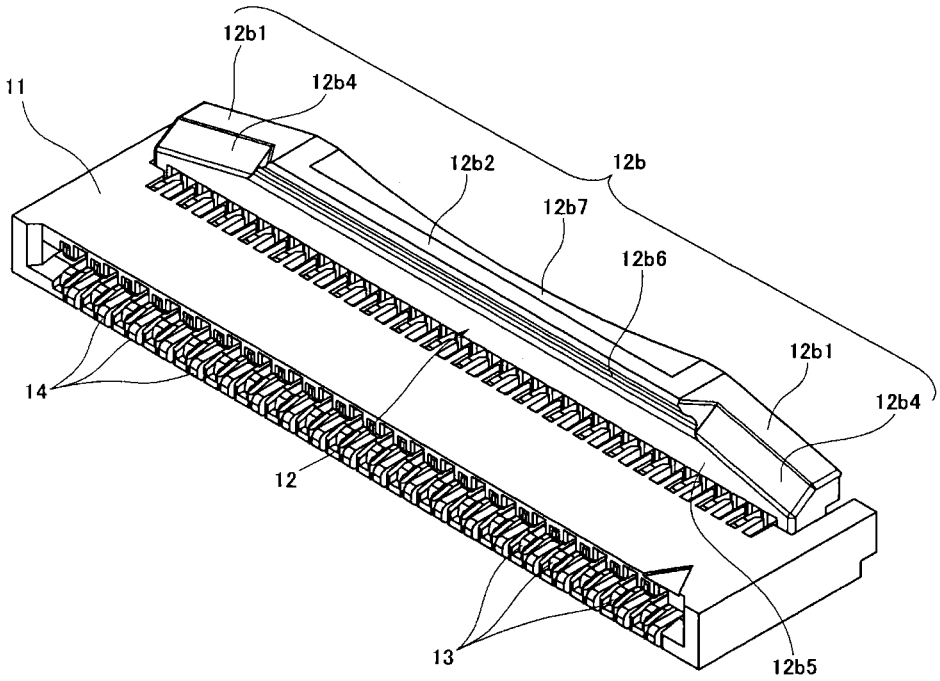
FIG. 18 is a descriptive external perspective view of an electric connector according to a second embodiment of the present invention, showing an entire structure when viewed from a front side in the state where an actuator stands at a connection release position with a signal transmission medium not being inserted.
Figure 19:
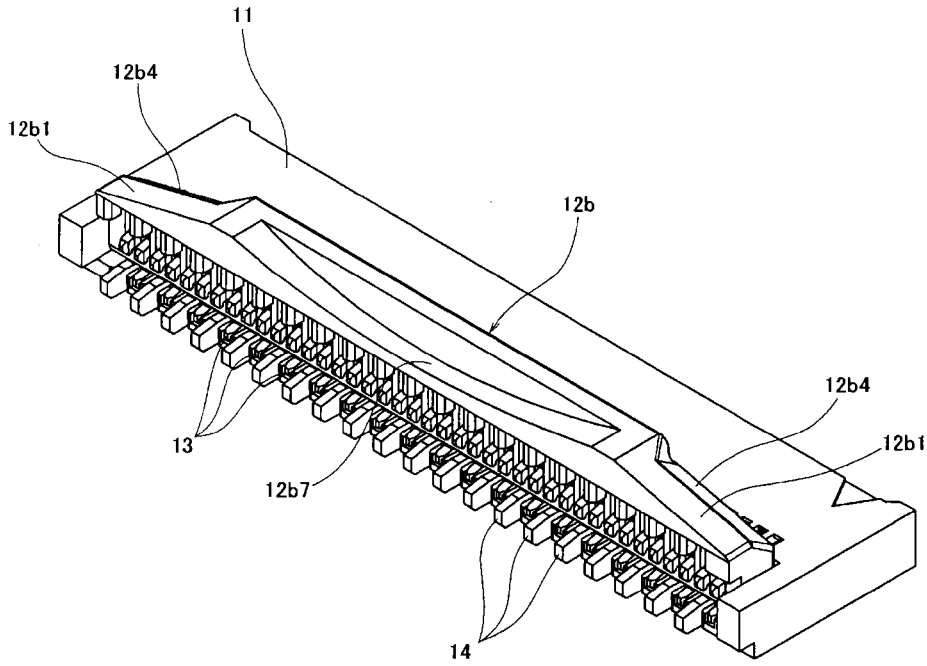
FIG. 19 is a descriptive external perspective view of the electric connector in the connection release state depicted in FIG. 18 when viewed from a rear side.
Figure 20:
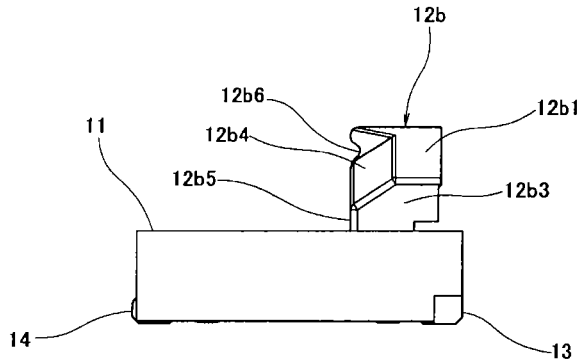
FIG. 20 is a descriptive side view of the electric connector depicted in FIG. 18 and FIG. 19.

By contrast, in a second embodiment depicted in FIG. 18 to FIG. 20 with same components provided with the same reference character as that of the first embodiment described above, in addition to the inclined surface parts 12*b*1, operation prevention aiding parts 12*b*4 each formed of a separate inclined surface is provided at both end side portions in the connector longitudinal direction of the actuator 12. Each of these operation prevention aiding parts 12*b*4 is disposed at an upper end portion with the actuator 12 standing at the "connection release position" (refer to FIG. 20) and closer to the front on both side in the longitudinal direction. The operation prevention aiding part 12*b*4 is disposed at a position facing the operating force added to the actuator 12 when the actuator 12 is pushed down in a pinching direction from the state of freeing the signal transmission medium (such as FPC or FFC) F.

That is, each operation prevention aiding part 12*b*4 is formed of a separate inclined surface adjacently disposed along the inclined surface part 12*b*1. The inclined surface configuring the operation prevention aiding part 12*b*4 is disposed so as to be along a front side of the inclined surface part 12*b*1. More specifically, one end edge of the inclined surface of the operation prevention aiding part 12*b*4 is adjacently disposed so as to configure an end edge that is common as an end edge of the inclined surface on a front end side forming the inclined surface part 12*b*1, and extends from one end edge (common edge) of the operation prevention aiding part 12*b*1 to an outer end edge of a front-side rising wall part 12*b*5 in a radial direction, the front-side rising wall part 12*b*5 extending in an approximately flat shape along the rotational radial direction of the actuator 12 and also along the longitudinal direction of the actuator 12. The inclined angle of the operation prevention aiding part 12*b*4 at which it extends is set as appropriate downward with respect to the rotational radial direction of the actuator 12.

Also, the front-side rising wall part 12*b*5 described above extends so as to form a front end face (a left end face in FIG. 20) with the actuator 12 standing at the "connection release position" (refer to FIG. 20). An upper end edge of the front-side rising wall part 12*b*5 and the other end edge of the inclined surface of each operation prevention aiding part 12*b*4 are adjacently disposed so as to configure a common edge edge. As such, each operation prevention aiding part 12*b*4 is inclined so as to go down toward outside in the connector longitudinal direction together with the inclined surface forming each inclined surface part 12*b*1, and is also inclined so as to go down toward the front side.

As such, according to the second embodiment including the operation prevention aiding parts 12*b*4 extending so as to be inclined toward the front side in addition to the inclined surface parts 12*b*1 according to the first embodiment described above, the fingertip of the operator further tends not to be hooked at the front portion on both side in the longitudinal direction of the actuator 12. As a result, at the time of operation of rotating the actuator 12, the operation pressing force added from the operator tends to further uniformly act over the full length, and the action of pinching the signal transmission medium (such as FPC or FFC) F by the rotation of the actuator 12 is excellently performed.

Furthermore, first and second operation support parts 12*b*6 and 12*b*7 each formed of a concave part are provided on an approximately center portion in the longitudinal direction of the actuator 12. These first and second operation support parts 12*b*6 and 12*b*7 are provided so as to extend along the longitudinal direction on front and rear rising walls of the actuator 12, that is, the front-side rising wall part 12*b*5 described above and a rear-side rising wall part on an opposite side, respectively.

Of these, the concave part configuring the first operation support part 12*b*6 is formed in the front-side rising wall part 12*b*5, that is, a front end face (a left-side end face in FIG. 20) with the actuator 12 standing at the "connection release position" (refer to FIG. 20), and is formed of an elongated groove approximately linearly extending along the connector longitudinal direction. The concave part is formed to have a shape allowing engagement of a fingertip of the operator of the actuator 12 when the actuator 12 is operated as being rotated from the state of freeing the signal transmission medium (such as FPC or FFC) F to a pinching direction.

By contrast, the second operation support part 12*b*7 is formed in the rear-side rising wall part of the actuator 12, that is, a lower end face (a lower-side end face in FIG. 11) with the actuator 12 being laid at the "connection acting position" (refer to FIG. 11), and is formed of a recessed part extending in an approximately curved line along the connector longitudinal direction. The curved line forming an outer line of this second operation support part 12*b*7 is shaped with its center portion in the longitudinal direction swells approximately in the shape of an arc toward inside in the rotational radial direction of the actuator 12, and is shaped so that a nail part of the operator of the actuator 12 can be engaged when the actuator 12 is operated from the state of pinching the signal transmission medium (such as FPC or FFC) F to a freeing direction.

According to the present embodiment with the above-structured first and second operation support parts 12*b*6 and 12*b*7, at the time of operation of rotating the actuator 12, the finger tip part or the nail part of the operator of the actuator 12 is easily hooked at the first and second operation support parts 12*b*6 and 12*b*7 at the center portion in the longitudinal direction. That is, the fingertip part of the operator can be easily and reliably engaged with the linearly-shaped first operation support part 12*b*6, and the nail part of he operator can be easily and reliably engaged with the curve-shaped second operation support part 12*b*7. Therefore, with these linear and curved operation support parts 12*b*6 and 12*b*7 disposed as appropriate on the front and rear rising walls according to the state of rotating operation of the actuator 12, excellent rotation operability can be obtained. Also, since operation pressing force added from the operator is positively received at the center portion of the actuator 12, uniform operability can be reliably obtained over the full length.

Note that the first and second operation support parts 12*b*6 and 12*b*7 in the present embodiment are each formed of a concave part, similar operations and effects can be obtained by configuring these parts each with the use of a convex part.

While the invention made by the inventor has been specifically described based on the embodiment, the present invention is not meant to be restricted to the embodiment described above, and it goes without saying that the present invention can be variously modified within a range not deviating from the gist of the invention.

For example, in the embodiment described above, while a flexible printed circuit (FPC) or a flexible flat cable (FFC) is adopted as a signal transmission medium to be fixed to the electric connector, the present invention can be similarly applied to the case in which another medium for signal transmission or the like is used.

Also, while the actuator according to the embodiments described above is disposed in the rear end portion of the insulating housing, the present invention can also be applied to an electric connector with the actuator disposed in a front end portion and an electric connector with the actuator disposed in a portion between the front and rear end portions.

Furthermore, while the conductive contacts having different shapes are used in the electric connector according to the embodiment described above, the present invention can be similarly applied even when conductive contacts having the same shape are used.

The present invention can be widely applied to various types of electric connectors for use in various electric apparatuses.

What is claimed is:

1. An electric connector in which an actuator pinching or freeing a signal transmission medium is provided so as to be rotatable about a rotation center extending in a longitudinal direction of the actuator, wherein inclined surface parts extending to form an appropriate angle with respect to the longitudinal direction are provided in outer end faces in a radial direction regarding the rotation center of the actuator and at both end portions in the longitudinal direction of the actuator, wherein a flat part extending in the longitudinal direction is provided in a portion between the inclined surface parts provided at the both end portions in the longitudinal direction, and the inclined surface parts are formed so as to smoothly continue from both end parts in the longitudinal direction of the flat part, wherein rising wall parts extending in an approximately flat shape along a rotational radius direction of the actuator are provided at both end edge parts in the longitudinal direction of the actuator, and the inclined surface parts are provided so as to continue from outer end edges in a rotational radius direction of the rising wall parts, wherein each of the inclined surface parts is provided with an operation prevention aiding part formed of a separate inclined surface adjacently disposed along the inclined surface part, and the operation prevention aiding part extends from the inclined surface part to an outer end edge in a radial direction of a rising wall part extending in an approximately flat shape along the rotational radius direction of the actuator and along the longitudinal direction of the actuator to form an appropriate angle with respect to the rotational radius direction of the actuator, and wherein an operation support part formed of a concave part or a convex part extending along the longitudinal direction of the actuator are provided at a center portion of a rising wall part in the longitudinal direction, the rising wall part extending in an approximately flat shape along the rotational radius direction of the actuator and along the longitudinal direction of the actuator, the operation support part being provided in a portion where an operating force is added in a pinching direction from a state of freeing the signal transmission medium and a portion where an operating force is added in a freeing direction from a state of pinching the signal transmission medium.

2. The electric connector according to claim 1, wherein the appropriate angle formed by the inclined surface parts with respect to the longitudinal direction is set in a range of 4 degrees to 15 degrees.

3. The electric connector according to claim 1, wherein the operation prevention aiding part is disposed so as to face an operating force added to the actuator when the actuator is operated in a pinching direction from a state of freeing the signal transmission medium.

4. The electric connector according to claim 1, wherein the concave part or the convex part configuring the operation support part is formed in a shape allowing engagement of a fingertip part or a nail part of an operator of the actuator.

5. The electric connector according to claim 4, wherein the operation support part is formed so as to extend in a curve or a straight line along the longitudinal direction of the actuator.

* * * * *